US006612845B1

(12) United States Patent
Macri et al.

(10) Patent No.: US 6,612,845 B1
(45) Date of Patent: Sep. 2, 2003

(54) APPARATUS AND METHOD FOR TRAINING BODY MOVEMENTS IN ATHLETICS

(76) Inventors: Mark A. Macri, 66954 Graham Rd., St. Clairsville, OH (US) 43950; Lew Wright, 25 Aaron Way, Wheeling, WV (US) 26003

( * ) Notice: Subject to any disclaimer, the term of this patent is extended or adjusted under 35 U.S.C. 154(b) by 25 days.

(21) Appl. No.: 09/713,727

(22) Filed: Nov. 15, 2000

Related U.S. Application Data

(60) Provisional application No. 60/166,124, filed on Nov. 18, 1999.

(51) Int. Cl.[7] ..... A63B 69/00; A63B 21/04; A63B 21/085

(52) U.S. Cl. ..... 434/247; 434/248; 434/252; 482/95; 482/96; 482/121; 482/122; 482/123; 482/124; 482/129; 473/207; 473/212; 473/215; 473/216

(58) Field of Search ..... 434/247, 252; 244/151 R; 482/124, 69, 130, 96, 121, 122, 123, 129; 602/19; 473/207, 212, 215, 216

(56) References Cited

U.S. PATENT DOCUMENTS

| | | | | | |
|---|---|---|---|---|---|
| 552,971 | A | * | 1/1896 | Sandow | 482/124 |
| 1,402,179 | A | * | 1/1922 | Piscitelli | 482/124 |
| 2,498,006 | A | | 2/1950 | Ridill | 273/35 |
| 3,124,326 | A | * | 3/1964 | Bockelmann | 244/151 R |
| 3,258,788 | A | * | 7/1966 | Anciaux | 182/3 |
| 3,452,374 | A | * | 7/1969 | Turner | 244/151 R |
| 3,559,932 | A | * | 2/1971 | Ternes | 244/151 R |
| 3,595,583 | A | * | 7/1971 | Oppenheimer | 273/DIG. 21 |
| 3,820,794 | A | * | 6/1974 | Inoue | 473/215 |
| 3,972,238 | A | * | 8/1976 | Thatcher | 434/251 |
| 4,121,688 | A | * | 10/1978 | Lirakis | 182/3 |
| 4,134,589 | A | | 1/1979 | Arena | 273/183 B |
| 4,353,556 | A | | 10/1982 | Self et al. | 273/186 A |
| 4,359,221 | A | | 11/1982 | Taylor | 273/54 B |

(List continued on next page.)

OTHER PUBLICATIONS

A Neuropsychological Theory of Motor Skill Learning; Daniel B. Willingham; 1998; vol. 105, No. 3, pp. 558–584.
Adaptive Representation of Dynamics during Learning of a Motor Task; Reza Shadmehr et al.; May 1994; pp. 3208–3224.
Review of the Afferent Neural System of the Knee and Its Contribution to Motor Learning; John Nyland et al.; Jan. 1994; vol. 19, No. 1, pp. 2–11.

*Primary Examiner*—Derris H. Banks
*Assistant Examiner*—Dmitry Suhol
(74) *Attorney, Agent, or Firm*—Webb Ziesenheim Logsdon Orkin & Hanson, P.C.

(57) ABSTRACT

An apparatus for training body movements in athletics includes a waist strap configured for attachment around the torso of a wearer and having a plurality of attachment rings connected detachably thereto, and a shoulder strap configured for attachment around the wearer's shoulders and having two cooperating ends. The shoulder strap is configured to extend around the wearer's shoulders and under the wearer's arms such that the cooperating ends are connectable together at a point located substantially between the wearer's shoulder blades. The shoulder strap further includes a plurality of attachment rings connected detachably thereto. The apparatus may further include leg straps configured for attachment around the wearer's legs and arm straps configured for attachment around the wearer's arms. The leg and arm straps may each include a plurality of attachment rings connected detachably thereto. Furthermore, a plurality of elastic bands may be connected in a predetermined arrangement to the attachment rings connected to the waist strap, the shoulder strap, the leg straps and the arm straps for exerting pressure in directions opposite to the directions of intended body movements or stabilized postures for the athletic movement.

6 Claims, 7 Drawing Sheets

U.S. PATENT DOCUMENTS 4,632,217 A * 12/1986 Markwell et al. ..... 182/3
4,976,623 A * 12/1990 Owsley ..... 434/247
5,024,443 A 6/1991 Bellagamba ..... 273/188 R
5,048,836 A 9/1991 Bellagamba ..... 273/183 B
5,062,642 A 11/1991 Berry et al. ..... 273/183 B
5,135,470 A * 8/1992 Reeves ..... 2/44
5,186,701 A * 2/1993 Wilkinson ..... 482/121
5,209,482 A 5/1993 Hopfer ..... 273/187.2
5,271,617 A 12/1993 Gilford ..... 273/1.5 A
5,303,927 A 4/1994 Perry et al. ..... 273/188 R
5,308,074 A 5/1994 Dorotinsky et al. .... 273/188 R
5,330,417 A 7/1994 Petersen et al. ..... 602/16
5,435,563 A * 7/1995 Salvatore ..... 128/870
5,474,299 A 12/1995 Romano ..... 273/187.2
5,613,926 A * 3/1997 Michaelson ..... 482/121
5,803,881 A 9/1998 Miller ..... 482/124
5,820,533 A * 10/1998 Goldman ..... 482/124
5,993,362 A * 11/1999 Ghobadi ..... 482/121
6,036,625 A * 3/2000 Woodruff ..... 482/121
6,101,631 A * 8/2000 Ferguson, Jr. ..... 182/3
6,132,346 A * 10/2000 Weeks ..... 482/124

* cited by examiner

APPARATUS AND METHOD FOR TRAINING BODY MOVEMENTS IN ATHLETICS

This application claims the benefit of U.S. Provisional Patent Application Ser. No. 60/166,124, filed Nov. 18, 1999, entitled "Apparatus and Method for Training Body Movements in Athletics".

BACKGROUND OF THE INVENTION

The present invention relates to an apparatus and method for training body movements and, more particularly, to an apparatus and method for training body movements in athletics.

In its broadest form, the present invention relates to a system for learning motor skills that includes an apparatus and method from which any type of body movement may be taught and reinforced. The present invention utilizes the concept of proprioceptive neuromuscular facilitation which, simply stated, is a method of stimulating proprioceptors and muscles in the human body to assist the brain in developing new neurological pathways and kinematic plans to perform motor skills. Essentially, proprioceptive neuromuscular facilitation as applied in the method according to the present invention stimulates the proprioceptive feedback to the muscles and brain by applying a force in the opposite direction of the desired movement. The motor centers in the brain respond by stimulating contraction of the muscles required to produce the desired action. In this way, an instructor, teacher or coach can "program" the desired muscle action to assist the student in learning the correct form for a desired athletic movement.

Coaches and athletes are always in search of new methods to facilitate teaching and learning of motor skills and enhance performance. When broken down into basic components, the presently known prior art methods for teaching motor skills include visual and verbal instructions, simulation drills, and practice. These prior art teaching methods for teaching skilled motor activities are dependent on how well the student perceives the visual and verbal information and transforms it into a motor skill. When the student attempts to reproduce the motor skill demonstrated by the instructor or coach, he or she inevitably reverts to old neuromuscular patterns that have been generated over a lifetime and do not necessarily conform with the "correct" or desired movement. As the learning process continues and the student's actions more closely mirror the desired movement, the student, depending on his or her ability, plateaus and further progress is minimal. The reason for this lack of progress is that the student, no matter how well the training is provided, may not have the neuromuscular pathways developed to perform the desired action and, therefore, cannot reference the muscle contraction patterns necessary for improvement. Visual and verbal information generally cannot create the required new pathways because the motor centers of the brain do not understand this form of language.

Anatomical studies have identified specific neural pathways which supply information from proprioceptors regarding the condition of the peripheral motor system to the motor and sensory cortices of the brain. This information is utilized to calculate and coordinate motor function to produce smooth and fluid movements. The apparatus and method of the present invention are based on the theory that if the level of proprioceptive information transmitted from a given part of the body can be facilitated or "boosted" using the apparatus and techniques of the present invention, the student will be able to perform, incorporate into a kinematic plan, commit to memory, and ultimately learn the desired movement pattern in a faster and more efficient manner.

Research appearing in "The Journal of Neuroscience", May 1994, incorporated herein by reference, supports the principles behind the present invention. The research article appearing in "The Journal of Neuroscience" reports an experiment that was conducted to observe how test subjects adapted to changed dynamics of a reaching task. The test subjects were first allowed to practice a straight movement without any disturbance. A force was then applied skewing the trajectory of the test subject's hand. With practice, the test subjects were able to anticipate and overcome the force and again develop a straight path to the target. A pattern of movement was then observed when the applied force was discontinued. The pattern of movement, termed "aftereffects", was in the exact opposite direction to the force applied. In order to produce such a movement, the applied force facilitated proprioceptive and neuromuscular activity which created a movement opposite to the direction of the applied force. If an externally applied force can change the dynamics of a "correct" kinematic plan, it may also be applied according to the apparatus and method of the present invention to "correct" the dynamics of an incorrect kinematic plan.

DESCRIPTION OF THE PRIOR ART

The prior art known to the inventors is replete with devices and methods which utilize incorrect proprioceptive patterns that do not stimulate the appropriate muscles for learning a desired or intended athletic movement. In general, these devices tend to inhibit the "correct" muscles from contracting. For example, U.S. Pat. No. 5,803,881 to Miller discloses an athletic training belt for teaching proper hip and trunk rotation for pitching and batting in the sport of fast pitch softball. In particular, the athletic training belt disclosed by the Miller patent includes a belt which mounts to the hips and thighs of a wearer and includes a number of fasteners for selectively attaching one or more training bands. The fasteners are arrayed about the circumference of the hip and thigh straps comprising the athletic training belt. Varying degrees of resistance to the hip rotation are obtained upon selectively positioning appropriate elastic and/or static training bands to the fasteners at the front, sides, and rear of the hip and thigh straps. The athletic training belt is used by selectively applying forces to the front, side, and/or rear of the athlete to provide a counterforce when improperly performing a desired movement. The counterforce acts in a direction different to the incorrect movement, thereby providing feedback to the athlete indicating an improper movement. From this feedback, the athlete may correct the movement.

U.S. Pat. No. 5,062,642 to Berry et al. discloses a golf swing training device worn by a user for strengthening and training the legs. The device disclosed by the Berry et al. patent enables the user to sense where his or her legs should be when practicing a particular athletic movement by urging the user's legs in the direction of the intended movement. Other golf swing training devices are disclosed by U.S. Pat. Nos. 5,024,443 and 5,048,836 to Bellagamba. Each of the Bellagamba '443 and '836 patents discloses a pair of flexible arm encircling straps and an elastic strap extending from each of the arm straps that connects, respectively, to a pair of stationary upright members. The devices disclosed by the Bellagamba '443 and '836 patents apply forces to the arms and upper body of the user to urge the user to make a correct swing of the golf club. The forces act in the direction of the desired or intended movement.

Another typical example of training devices which use incorrect proprioceptive patterns is disclosed by U.S. Pat. No. 4,359,221 to Taylor. The device disclosed by the Taylor patent is an elastic strap which extends between the middle of a bowler's back and the upper portion of the bowler's free arm and inhibits the rearward movement of the bowling shoulder and/or rotational movement of the shoulders to achieve a correct follow through angle of less than 90 degrees. The strap does not urge the user's shoulder in an intended or desired direction but simply prevents an incorrect movement of the user's shoulder.

A final example is disclosed by U.S. Pat. No. 4,353,556 to Self et al. The Self et al. patent is directed to a golf club swing training aid that includes an alignment band which is attached to a pair of spaced apart mounting points to establish a straight base line for a "proper" golf stroke. A first tension member is attached to one of the mounting points and a second tension member is attached to the other mounting point. The other ends of the tension members are secured to the head of a golf club. The tension members urge the head of the golf club into alignment with the base line established by the alignment band which enables a golfer to practice a proper golf stroke by "feeling" the tension urging the head of the golf club in the direction of a "correct" golf stroke path or movement. The golf club swing training aid disclosed by the Self et al. patent attempts to "mimic" the correct movement for the golf stroke by urging the head of the golf club in the direction of the desired or intended movement. By attaching to the golf club, the device creates leverage that produces improper neuromuscular responses.

The object of the present invention is to provide an apparatus and method for training body movements in athletics which more easily and efficiently enables a student to learn a repeatable complex movement. It is also an object of the present invention to provide an apparatus and method for training body movements in athletics which utilizes the concept of proprioceptive neuromuscular facilitation to stimulate the proprioceptors and muscles in the human body to assist the brain in developing new neurological pathways and kinematic plans to perform complex motor movements. A further object of the present invention is to overcome the deficiencies present in the prior art athletic training devices discussed previously.

SUMMARY OF THE INVENTION

The above objects are accomplished with an apparatus for training body movements in athletics made in accordance with the present invention. The apparatus generally includes a waist strap and a shoulder strap. The waist strap is configured for attachment around the torso, particularly the pelvis or hips, of the wearer and has a plurality of attachment rings connected detachably thereto. The apparatus further includes a shoulder strap configured for attachment around the wearer's shoulders having two cooperating ends. The shoulder strap generally extends over the wearer's shoulders and under the wearer's arms such that the cooperating ends are connectable together at a point located substantially between the wearer's shoulder blades. The shoulder strap includes a plurality of attachment rings connected detachably thereto. The apparatus may further include leg straps configured for attachment around the wearer's legs. The leg straps may each include a plurality of attachment rings connected detachably thereto. In addition, the apparatus may include arm straps configured for attachment around the wearer's arms. The arm straps may each include a plurality of attachment rings connected detachably thereto. The shoulder strap may further include a detachable front strap positioned across the wearer's chest when the shoulder strap is attached to the wearer to further secure the shoulder strap to the wearer.

The apparatus preferably includes a plurality of elastic bands connected in a predetermined arrangement to the attachment rings connected to the waist strap and the shoulder strap for exerting pressure in directions opposite to the directions of intended movements for the athletic movement. The elastic bands may be further connected to the attachment rings connected to the leg straps for exerting pressure in directions opposite to the directions of intended leg movements for the athletic movement. Furthermore, the plurality of elastic bands may be connected to the attachment rings connected to the arm straps for exerting pressure in directions opposite to the directions of intended arm movements for the athletic movement or, stated otherwise, in the direction of the improper movement.

The apparatus described hereinabove is preferably used in combination with a rectangular-shaped support structure. The support structure may include a base member configured to be positioned against the ground, at least two vertical posts, and at least one cross member connected detachably between the posts. The posts may be positioned at opposing corners of the base member. The cross member may be adjustable in a vertical direction relative to the posts. The plurality of elastic bands may be connected in the predetermined arrangement between the support structure and the attachment rings connected to the waist strap and the shoulder strap for exerting pressure in directions opposite to the directions of intended body movements for the athletic movement. The system may further include leg straps configured for attachment around the wearer's legs. The plurality of elastic bands may be further connected to the attachment rings connected to the leg straps for exerting pressure in directions opposite to the directions of intended leg movements for the athletic movement. In addition, the system may include arm straps configured for attachment around the wearer's arms. The elastic bands may be further connected to the attachment rings connected to the arm straps for exerting pressure in directions opposite to the directions of the intended arm movements for the athletic movement.

A method of training body movements in athletics using the apparatus and support structure discussed hereinabove is also part of the present invention. Further details and advantages of the present invention will become apparent with reference to the following detailed description, in conjunction with the drawings.

DETAILED DESCRIPTION OF THE PREFERRED EMBODIMENTS

Figure 1:
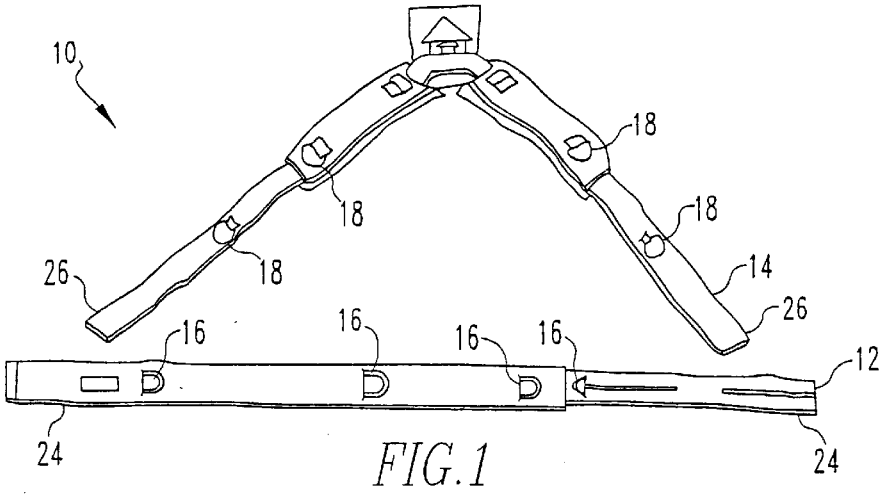
FIG. 1 is a top plan view of an apparatus for training body movements in athletics in accordance with the present invention.

Referring to FIG. 1, an apparatus for training body movements in athletics is shown and generally designated with reference numeral 10. The apparatus 10 is generally provided as a two-part device. In particular, the apparatus 10 includes a waist strap 12 configured for attachment around a wearer's torso, such as at the pelvis or hips, and a shoulder strap 14 configured for attachment around the wearer's shoulders. The waist strap 12 includes a plurality of attachment rings 16, such as D-rings, connected detachably to the waist strap 12. The shoulder strap 14 also includes a plurality of attachment rings 18 connected detachably to the shoulder strap 14. The present invention envisions that the attachment rings 16, 18 may be added to and subtracted from the waist and shoulder straps 12, 14, respectively, as necessary and positioned selectively along the length of the waist and shoulder straps 12, 14. The waist and shoulder straps 12, 14 are preferably made of a flexible and strong material such as nylon webbing.

Arm straps and leg straps, discussed hereinafter in connection with FIGS. 7–10, may be included as part of the apparatus 10. The arm straps and leg straps will be substantially identical to the waist strap 12, but made smaller than the waist strap 12 to more comfortably attach to the wearer's arms and legs. Alternatively, the waist strap 12 may be made sufficiently adjustable to attach around the wearer's arms or legs.

Figure 2:
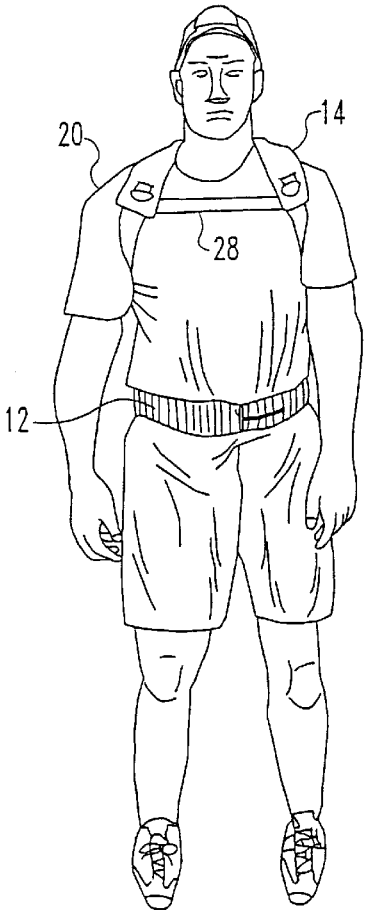
FIG. 2 is a front view of the apparatus of FIG. 1 showing the apparatus attached to a person.
Figure 3:
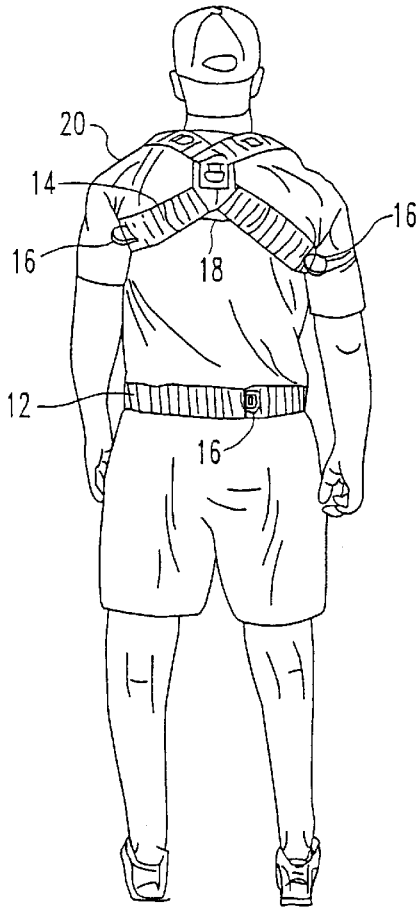
FIG. 3 is a rear view of the apparatus of FIG. 2.

Referring to FIGS. 2 and 3, the apparatus 10 is shown attached to a wearer 20. The waist belt 12 extends around the wearer and further includes two free ends 24. The ends 24 of the waist strap 12 preferably connect together at the front of the wearer 20. The ends 24 of the waist strap 12 may be connected adjustably together by any means customary in the art such as with a belt buckle, Velcro® straps, snaps, or other fastening device.

The shoulder strap 14 further includes cooperating ends 26. The shoulder strap 14 is configured to extend over the wearer's shoulders and under the wearer's arms such that the cooperating ends 26 of the shoulder strap 14 are connectable together at a point located substantially between the wearer's shoulder blades, as shown in FIG. 3. The cooperating ends 26 of the shoulder strap 14 may be connected adjustably together by cooperating Velcro® strips, a belt buckle, or by any other means customary in the art. A detachable front strap 28 may be connected to the shoulder strap 14 across the wearer's chest to further secure the shoulder strap 14 onto the wearer 20. The front strap 28 may also be integrally formed with or permanently connected to the shoulder strap 14.

Figure 11:
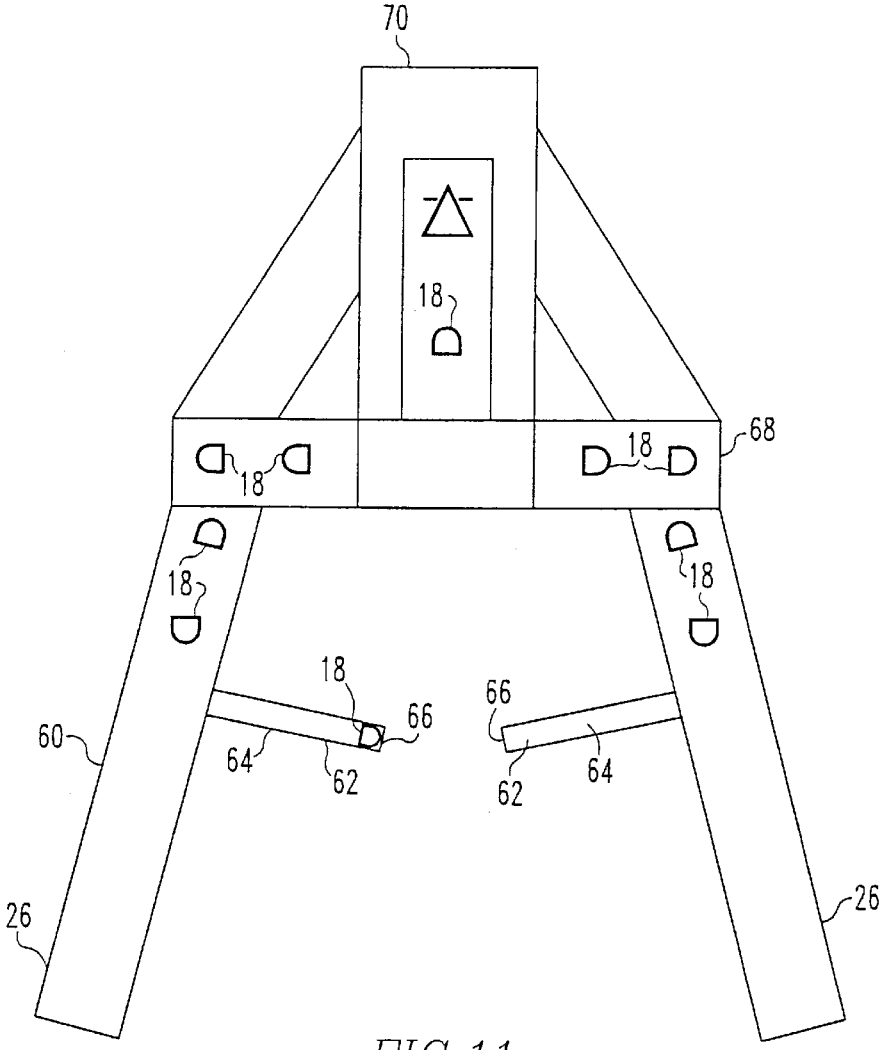
FIG. 11 is a top plan view of a second embodiment of a shoulder strap of the apparatus for training body movements in athletics in accordance with the present invention.

A second embodiment of a shoulder strap 60 of the apparatus 10 is shown in FIG. 11. The shoulder strap 60 may be similar to the shoulder strap 14 (shown in FIG. 1) in all aspects except as described below. The shoulder strap 60 includes the plurality of attachment rings 18, the cooperating ends 26, and a detachable front strap 62. In this embodiment, the front strap 62 includes two side straps 64 and at least one attachment ring 18 connected detachably to either of the two side straps 64. Each of the two side straps has a cooperating end 66 such that when the front strap 62 is connected to the shoulder strap 60 across the wearer's chest, the cooperating ends 66 may be connected adjustably together by cooperating Velcro® strips, a belt buckle, or by any other means customary in the art.

The shoulder strap 60 may also include a detachable stabilizer strap 68 and a detachable back strap 70. The stabilizer strap 68 may be connected to the shoulder strap 60 across the wearer's back to further secure the shoulder strap 60 onto the wearer. The stabilizer strap 68 may also be integrally formed with or permanently connected to the shoulder strap 60. At least one attachment ring 18 may be located on the stabilizer strap 68. The back strap 70 may be connected to the shoulder strap 60 and/or the stabilizer strap 68 to be positioned substantially between the wearer's shoulder blades. The back strap 70 may also be integrally formed with or permanently connected to the shoulder strap 60. At least one attachment ring 18 may be located on the back strap 70.

Figure 4:
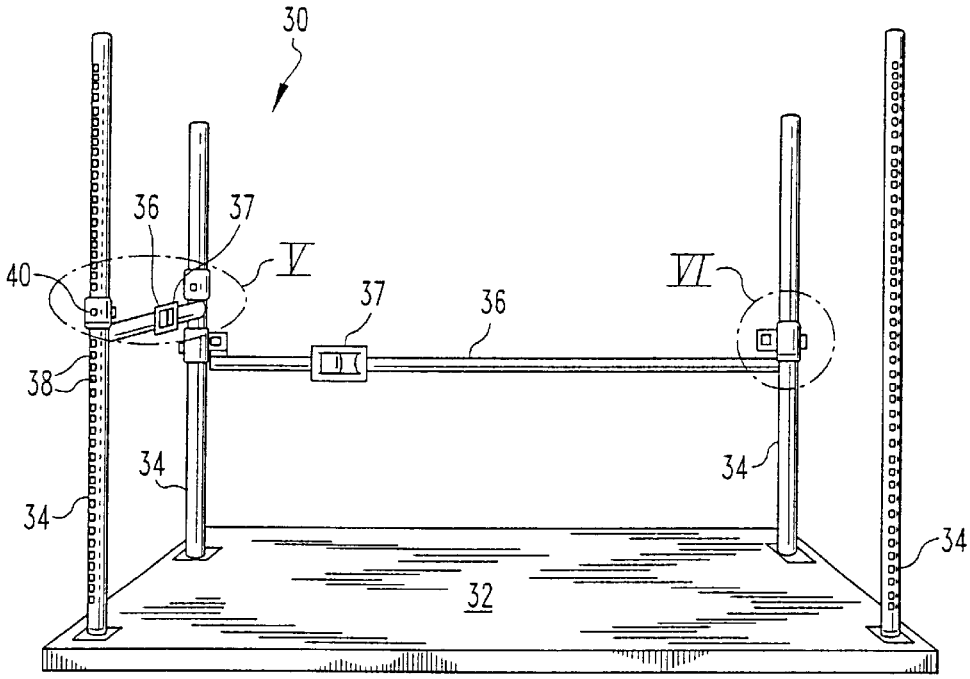
FIG. 4 is a perspective view of a support structure configured for use with the apparatus shown in FIG. 1.
Figure 5:
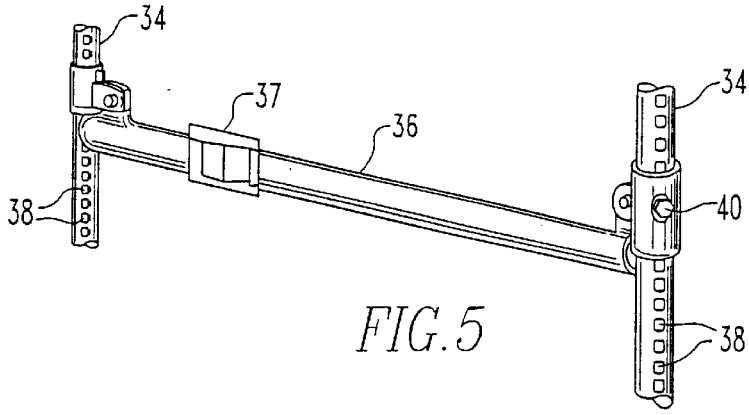
FIG. 5 is a perspective view of an adjustable cross member of the support structure shown in FIG. 4.
Figure 6:
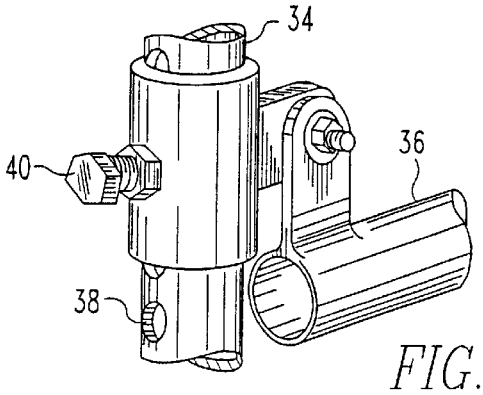
FIG. 6 is a perspective view of one end of the cross member shown in FIG. 5.

The apparatus 10 after being attached to the wearer 20 is preferably used with a support structure 30, the details of which are discussed hereinafter in connection with FIGS. 4–6. The support structure 30 generally includes a rectangular-shaped base or platform member 32 having four vertical posts 34 connected thereto. The posts 34 are generally positioned at the corners of the base member 32 and may be permanently affixed to the base member 32 with mechanical fasteners or, alternatively, detachably connected to the base member 32. The vertical posts 34 may be mounted in the same configuration separately to the ground in a permanent receptacle to allow for removal of the vertical posts 34 for storage and maintenance of grounds. The base member 32 is configured to engage the ground and may be a raised platform as shown in FIGS. 3 and 4. A plurality of vertically adjustable cross members 36 is connected between the posts 34. The cross members 36 are adjustable in a vertical direction relative to the posts 34 to suit the height of the wearer 20 utilizing the apparatus 10 and the support structure 30. Sliding anchors 37 can be provided on the cross members 36. The posts 34 and the cross members 36 of the support structure 30 are preferably made of steel tubing or plastic pipe. The sliding anchors 37 are preferably made of steel or plastic. The base member 32 may be made of wood, metal, or plastic.

The posts 34 each have a plurality of holes 38 defined therethrough. The cross members 36 are connected to the respective posts 34 with spring-loaded pins 40 which engage the holes 38. The vertical height of the cross members 36 may be simply and easily adjusted by detaching the pins 40 from the holes 38 in the posts 34 and moving the cross members 36 up or down to the selected height and re-engaging the pins 40 with the holes 38, as will be appreciated by those skilled in the art.

Figure 7:
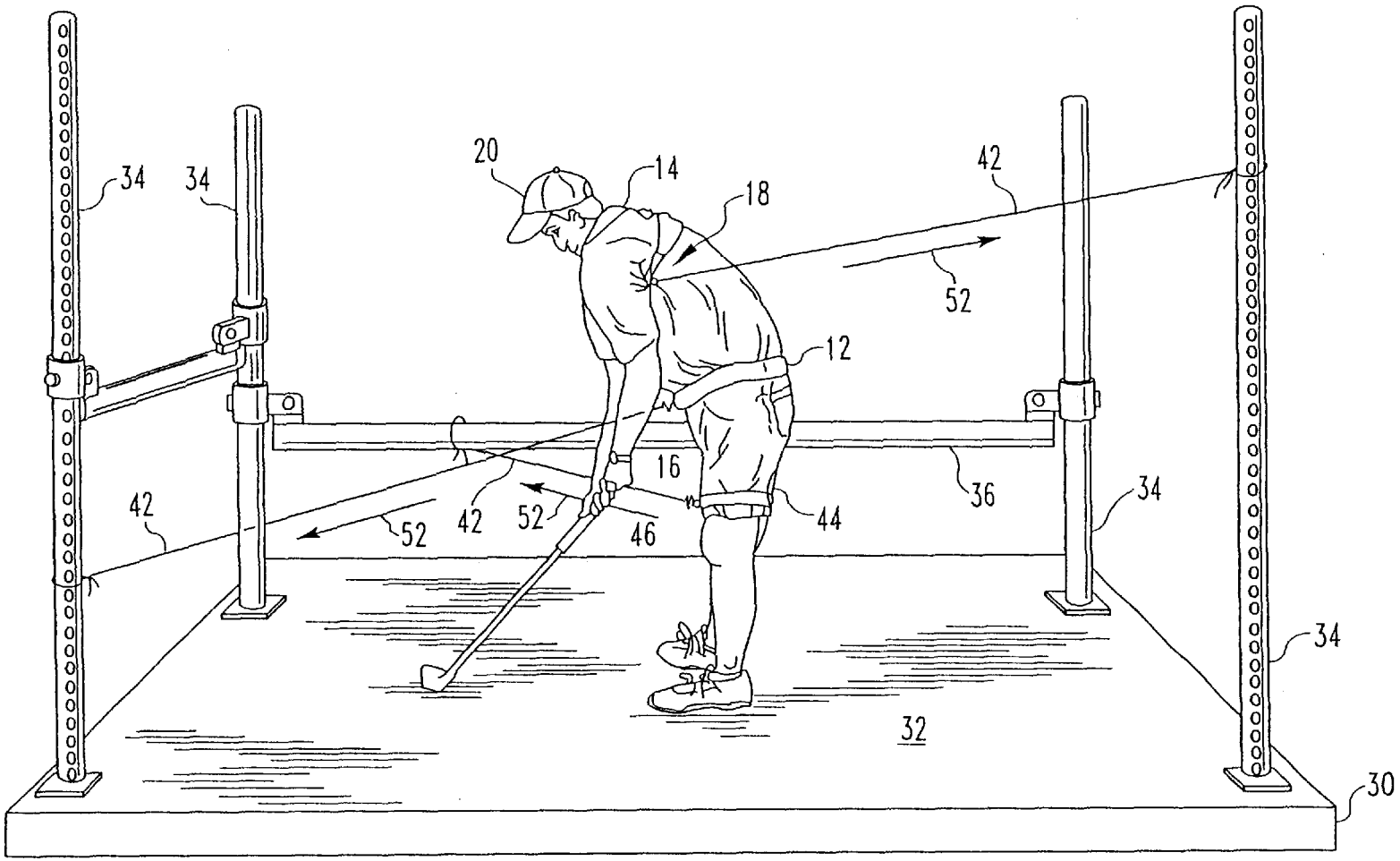
FIG. 7 is a front perspective view of an athletic training system for training body movements in athletics in accordance with the present invention and utilized to teach a golf stroke.

The apparatus 10 worn by the wearer 20 is used with the support structure 30 as part of a method of training body movements in athletics as discussed hereinafter with reference to FIGS. 7–10. FIG. 7 shows the apparatus 10 with the waist strap 12 positioned around the wearer's waist and the shoulder strap 14 positioned around the wearer's shoulders. A plurality of elastic bands 42 is connected between the waist strap 12 and the support structure 30 and, further, between the shoulder strap 14 and the support structure 30. The elastic bands 42 are preferably elastic tubing having a diameter of about ⅛ to ⅜ of an inch and made of an elastic material such as latex.

In particular, the elastic bands 42 are attached at one end to the attachment rings 16, 18 connected, respectively, to the waist strap 12 and the shoulder strap 14. The other ends of the elastic bands 42 attach to support structure 30. The elastic bands 42 may be simply tied to the support structure 30 or include releasable hooks (not shown) at both ends of each of the elastic bands 42 which are easily connectable to the attachment rings 18, 20 and the support structure 30. The elastic bands 42 may be attached to the sliding anchors 37 on cross members 36.

Figure 8:
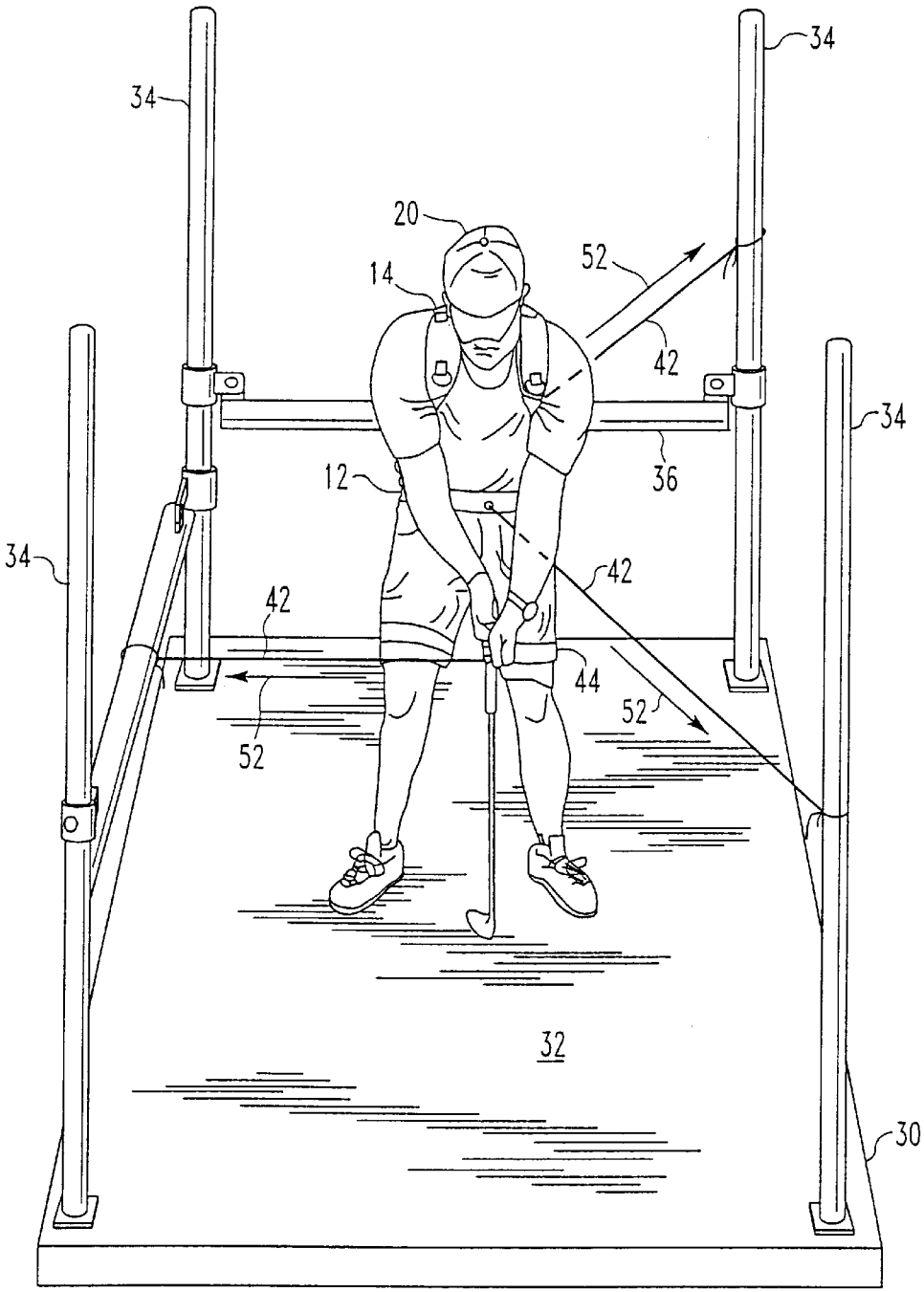
FIG. 8 is a side perspective view of the athletic training system shown in FIG. 7.
Figure 9:
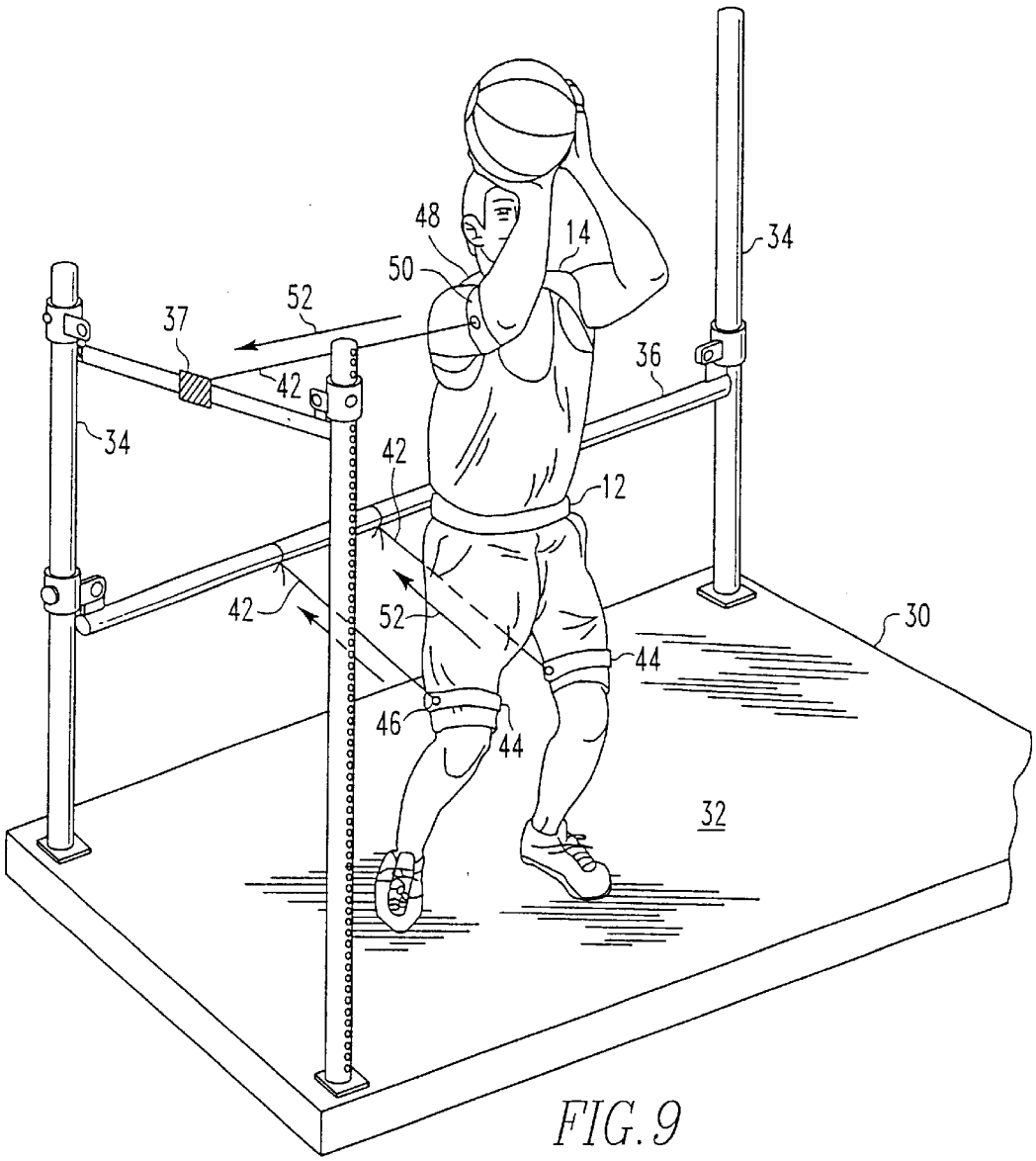
FIG. 9 is a perspective view of the athletic training system of FIG. 7 showing the system configured to teach a basketball shot.

In addition, the apparatus 10 shown in FIGS. 7–9 further includes leg straps 44 positioned around the legs of the wearer 20. The leg straps 44 each include a plurality of attachment rings 46 connected thereto configured to cooperate with the elastic bands 42. Only one attachment ring 46 is shown in the figures. The elastic bands 42 are connected between the attachment rings 46 connected to the leg straps 44 and the support structure 30. Furthermore, the apparatus 10 shown in FIGS. 9 and 10 includes an arm strap 48 positioned around the right arm of the wearer 20. The arm strap 48 further includes a plurality of attachment rings 50 connected thereto configured to cooperate with the elastic bands 42. Only one attachment ring 50 is shown in the figures. The elastic bands 42 are connected between the attachment rings 50 and the support structure 30.

Referring now, in particular to FIGS. 7 and 8, the apparatus 10 attached to the wearer 20 is utilized with the support structure 30 to teach proper torso rotation and leg movement for a golf swing. Arrows 52 in FIGS. 7 and 8 indicate the direction of force applied by the elastic bands 42. The elastic band 42 attached to the shoulder strap 12 extends between the attachment ring (not shown) located under the wearer's arm and the post 34 located to the left and rear of the wearer 20 in FIG. 7. The elastic band 42 attached to the waist strap 12 extends between the attachment ring 18 at the front of the waist strap 12 and the post 34 located to the left and front of the wearer 20 in FIG. 7. Finally, the elastic band 42 attached to the left leg strap 44 extends from the leg strap 44 to the cross bar 36 which extends between the posts 34 of the support structure 30 located to the right of the wearer 20 in FIG. 7. In each case, the respective elastic bands 42 exert a force in a direction opposite to the intended body movement for the golf swing. For example, the elastic band 42 attached to the leg strap 44 urges the wearer's leg in a direction across the wearer's body and toward the right side of the wearer 20, as viewed from the perspective of the wearer 20 in FIGS. 7 and 8. A common swing flaw is to collapse the left leg toward the right side. By applying a force in the direction as shown in 46, the student would increase their awareness of the proper muscle contraction pattern to stabilize the extremity in the appropriate position. Similarly, pressure is applied by the elastic band 42 connected to the shoulder strap 12 in a direction to the left and rear of the wearer 20, which is opposite to the intended shoulder rotation for the back swing of the golf swing which would normally be to the right and downward as viewed from the perspective of the wearer 20 in FIGS. 7 and 8.

Another application for the apparatus 10 and support structure 30 used in the present method of training body movements in athletics is shown in FIG. 9. The apparatus 10 and support structure 30 shown in FIG. 9 are utilized to teach proper form for shooting a basketball. In FIG. 9, the leg straps 44 are connected around the wearer's legs. The leg straps 44 are connected to the cross member 36 located to the rear of the wearer by two elastic bands 42. An arm strap 48 is positioned around the wearer's arm and connected by one elastic band 42 to the cross member 36 located to the right of the wearer 20 in FIG. 9. In the arrangement shown in FIG. 9, the waist belt 12 is not used. The arrows 52 indicate force in the opposite direction of the desired or intended movement for the basketball shot. Consequently, the elastic bands 42 attached to the leg straps 44 exert a force on the upper legs of the wearer 20 to the rear of the wearer 20, which is opposite to the intended movement for the basketball shot which would be in a forward and upward direction as viewed from the perspective of the wearer 20. Similarly, the elastic band 42 attached to the arm strap 48 exerts a force on the wearer's elbow outwardly away from the wearer's body, which is opposite to the intended movement for the wearer's right arm which is to maintain the right upper arm in a vertical plane as the right arm is extended upward to the point where the basketball is released.

Figure 10:
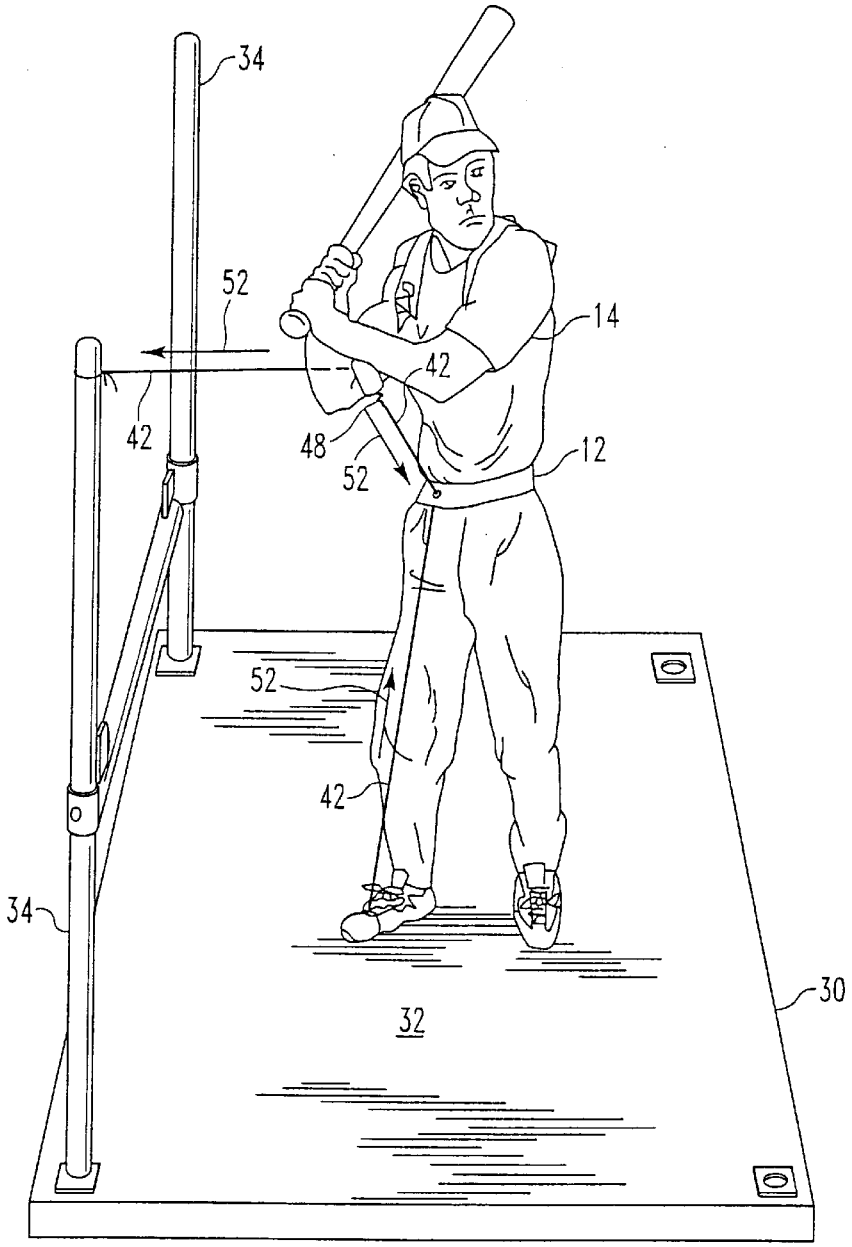
FIG. 10 is a perspective view of the athletic training system of FIG. 7 showing the system configured to teach a batting stance and shoulder rotation for batting in the sports of baseball and softball.

Finally, FIG. 10 illustrates a third application of the apparatus 10 and support structure 30 used in the present method for training body movements in athletics. The application shown in FIG. 10 facilitates a proper batting stance and shoulder rotation for batting in baseball or softball. In FIG. 10, the waist belt 12 is connected by an elastic band 42 to the wearer's right foot. The arm strap 48 is connected by an elastic band 42 to the cross member 36 located at the right of the wearer 20. In addition, the shoulder strap 12 is connected by an elastic band 42 to the cross member 36 located to the right of the wearer 20 in FIG. 10. The elastic band 42 connected to the arm strap 48 exerts a rearward force on the wearer's arm in the direction opposite to the intended movement which will be in a forward and downward rotating motion toward an incoming pitch. The elastic band 42 connected between the waist strap 12 and the wearer's foot exerts an upward force on the wearer's foot which must be overcome by the batter. In particular, the batter, or wearer 20, will contract the appropriate muscle groups in his right leg to maintain the right leg in a straightened condition to prevent the wearer's right leg from lifting off the ground in the face of an incoming pitch. Consequently, the elastic band 42 exerts a force in the opposite direction from the intended movement which, in this situation, is simply to contract those muscles necessary to keep the wearer's foot on the ground and right leg straightened. In this manner, the wearer 20 "learns" to maintain his foot in contact with the ground and right leg straightened. Likewise, the elastic band 42 connected to the shoulder strap 12 exerts pressure on the wearer's shoulder in the direction of the arrow 52, which is the direction opposite to the intended movement. The intended movement will be a rotational turn in which the wearer's right shoulder rotates forward and slightly downward toward the incoming pitch. The wearer 20 "learns" the correct shoulder turn for a batting swing when practicing batting swings while wearing the apparatus 10 utilized with the support structure 30. A third elastic band 42 is connected between the arm strap 48 and the waist strap 12 in FIG. 10.

The invention has been described with reference to preferred embodiments which are merely illustrative of the present invention and not restrictive thereof. Obvious modifications and alterations of the present invention may be made without departing from the spirit and scope of the present invention. It will be apparent that the apparatus 10 and support structure 30 may be utilized to teach any type of repeatable complex movement for conceivably any sport. For example, the apparatus and method of the present invention may be applied in the sports of tennis, golf, bowling, or basketball, or even in other applications such as martial arts or any other sports or activity requiring repeated skilled movements. The scope of the present invention is defined by the appended claims and equivalents thereto.

What is claimed is:

1. An athletic training system for training body movements in athletics, comprising:

a rectangular-shaped support structure further including:

a base member configured to be positioned against the ground;

at least two vertical posts, with the posts positioned at opposing corners of the base member; and at least one cross member connected detachably between the posts, with the cross member adjustable in a vertical direction relative to the posts;

an athletic training apparatus configured to cooperate with the support structure and further including:

a waist strap configured for attachment around the torso of a wearer and having a plurality of attachment rings connected detachably thereto; and a shoulder strap configured for attachment around the wearer's shoulders and having two cooperating ends, wherein the shoulder strap is configured to extend over the wearer's shoulders and under the wearer's arms such that the cooperating ends are connectable together at a point located substantially between the wearer's shoulder blades, and wherein the shoulder strap includes a plurality of attachment rings connected detachably thereto; and a plurality of elastic bands connected in a predetermined arrangement between the support structure and the attachment rings connected to the waist strap and the shoulder strap for exerting pressure in directions opposite to the directions of intended body movements for the athletic movement.

2. The system of claim 1, further including leg straps configured for attachment around the wearer's legs, with the leg straps each including a plurality of attachment rings connected detachably thereto, and wherein the plurality of elastic bands is connected further to the attachment rings connected to the leg straps for exerting pressure in directions opposite to the directions of intended leg movements for the athletic movement.

3. The system of claim 1, further including arm straps configured for attachment around the wearer's arms, with the arm straps each including a plurality of attachment rings connected detachably thereto, and wherein the plurality of elastic bands is connected further to the attachment rings connected to the arm straps for exerting pressure in directions opposite to the directions of intended arm movements for the athletic movement.

4. A method of training body movements in athletics, comprising the steps of:

facilitating neuromuscular activity by providing an athletic training apparatus, wherein the athletic training apparatus includes a waist strap and a shoulder strap, with the waist strap having a plurality of attachment rings connected detachably thereto, and with the shoulder strap having a plurality of attachment rings connected detachably thereto and two cooperating ends;

positioning the athletic training apparatus on a wearer;

applying through manipulation of the athletic training apparatus at least one force in an opposite direction to that of the desired body movement or stabilized position;

positioning the waist strap around the torso of a wearer;

positioning the shoulder strap over the wearer's shoulders and under the wearer's arms such that the cooperating ends connect together at a point located substantially between the wearer's shoulder blades;

connecting a plurality of elastic bands in a predetermined arrangement between a support structure and the attachment rings connected to the waist strap and the shoulder strap, wherein the support structure includes:

a base member configured to be positioned against the ground;

at least two vertical posts, with the posts positioned at opposing corners of the base member; and at least one cross member connected detachably between the posts, with the cross member adjustable in a vertical direction relative to the posts; and exerting pressure with the elastic bands in directions opposite to the directions of intended body movements for the athletic movement.

5. The method of claim 4, wherein:

the athletic training apparatus further includes leg straps configured for attachment around the wearer's legs, with the leg straps each including a plurality of attachment rings connected detachably thereto, and the method further includes the steps of:

attaching the leg straps to the legs of the wearer;

connecting the plurality of elastic bands to the attachment rings connected to the leg straps; and exerting pressure with the elastic bands in directions opposite to the directions of the intended leg movements for the athletic movement.

6. The method of claim 4, wherein the athletic training apparatus further includes arm straps configured for attachment around the wearer's arms, with the arm straps each including a plurality of attachment rings connected detachably thereto, and wherein the method further includes the steps of:

attaching the arm straps to the arms of the wearer;

connecting the plurality of elastic bands to the attachment rings connected to the arm straps; and exerting pressure with the elastic bands in directions opposite to the directions of the intended arm movements for the athletic movement.

* * * * *